United States Patent [19]

Gottlieb

[11] Patent Number: 5,064,196

[45] Date of Patent: Nov. 12, 1991

[54] PINBALL MACHINE HAVING PIVOTED DOUBLE-INCLINED PLAYING SURFACE

[76] Inventor: Alvin J. Gottlieb, 290 Cottage Hill, Elmhurst, Ill. 60126

[21] Appl. No.: 566,630

[22] Filed: Aug. 13, 1990

Related U.S. Application Data

[63] Continuation-in-part of Ser. No. 392,050, Aug. 10, 1989, Pat. No. 4,971,322.

[51] Int. Cl.[5] ..... A63D 3/02; A63F 7/00

[52] U.S. Cl. ..... 273/121 A; 273/118 A; 273/110; 273/126 A

[58] Field of Search ..... 273/121 A, 118 A, 129 V, 273/129 S, 121 R, 109, 110, 126 A

[56] References Cited

U.S. PATENT DOCUMENTS

| | | | |
|---|---|---|---|
| 2,300,328 | 10/1942 | Wilsey | 273/110 |
| 2,328,667 | 9/1943 | Nicolaus | 273/118 A |
| 2,658,755 | 11/1953 | Benak | 273/109 |
| 2,791,428 | 5/1957 | McDonald | 273/110 |
| 3,582,074 | 6/1971 | Menotti | 273/121 A |
| 3,643,946 | 2/1972 | Ylinen | 273/85 R |
| 3,669,452 | 6/1972 | Foley et al. | 273/119 R |
| 3,675,927 | 7/1972 | Gottlieb et al. | 273/119 |
| 4,173,341 | 11/1979 | Olliges | 273/126 A |
| 4,244,574 | 1/1981 | Milner et al. | 273/121 A |
| 4,598,910 | 7/1986 | Halliburton . | |

OTHER PUBLICATIONS

Brochure for the "JOUST" pinball game sold by Williams.

Brochure for a pinball game sold by Komputer Dynamics.

Brochure for Video games sold by Rock'N'Ball.

*Primary Examiner*—Stephen C. Pellegrino

*Assistant Examiner*—Gary Jackson

*Attorney, Agent, or Firm*—Willian, Brinks, Olds, Hofer, Gilson & Lione

[57] ABSTRACT

A pinball machine which includes a multisurface table which may be used by at least two players to play the game. Multiple surfaces are provided that connect at an apex, which can be lowered to form a flat or inverted playing surface. A scoring mechanism is provided such that the player corresponding to the game element that last struck the ball is credited with all subsequent points. Thus, the dual-surface table allows for simultaneous, truly competitive play by two or more players.

20 Claims, 3 Drawing Sheets

PINBALL MACHINE HAVING PIVOTED DOUBLE-INCLINED PLAYING SURFACE

This is a continuation-in-part of application Ser. No. 07/392,050, filed Aug. 10, 1989 now U.S. Pat. No. 4,971,323.

BACKGROUND OF THE INVENTION

The present invention relates generally to a rolling ball game such as a pinball game and more particularly to a pinball game having a pivoting, dual-inclined surface.

For years, pinball machines or games have provided a source of leisure time enjoyment for a variety of people. Despite the recent proliferation of computerized video arcades, pinball continues to be recognized as a popular pastime. Pinball games offer the player the ability to manipulate an actual physical object (the ball) as opposed to a character on a screen.

When playing pinball, a player usually sets the ball into play with a spring biased arm or plunger. As the ball strikes various scoring elements, such as post bumpers and slingshot bumpers, the player earns points according to the number of times the ball strikes the bumper and the point value of each bumper. The player has no control over the movement or placement of these scoring elements, and once he or she sets the ball into motion, the ball randomly strikes various bumpers and other scoring elements.

Because the ball rolling or playing surface of the pinball table is gently sloped, the force of gravity constantly urges the ball towards the base of the table. Usually mounted near the base of the table are two flippers that may be electro-mechanically actuated by the player by depressing the buttons located on the side of the machine's cabinet. By correctly timing the actuating of the flippers, the player can cause the flippers to strike the ball and propel it into the playing area to again contact the various scoring elements in order to score further points.

In contrast with the bumpers or other scoring elements, movement of the flippers is within the control of the player. These flippers do not detect ball contact like the bumpers, however, and no points are scored as a result of contact between the flipper and the ball. The flippers are merely ball propelling devices. The primary purpose of the flipper is to keep the ball in play and prevent it from escaping the playing field by passing through the space located between the flippers thereby ending the play of that particular ball. This limited control over the scoring elements of the game leaves the present pinball game with some deficiencies.

As developed over the years, pinball is primarily an individual activity. One player controls both flippers and the score is tabulated on a "per ball" basis. Although it is possible on tables that employ independently actuated flippers for a first player to control the actuation of one flipper and a second player to control the actuation of a second flipper, a single score is tabulated preventing the players from distinguishing themselves on the basis of score.

Most pinball machines allow two players to "compete" with one another by allowing a first player to play one ball and retaining that player's score on a visible scoring board. The second player then plays a ball which is scored separately. Thus, at the conclusion of the second player's game, the two players can compare scores to see who scored the greater number of points and thereby determine the winner.

The primary problem with competitive pinball played on a machine as described above is that only one player can play at a time. There is always one player who is not involved in the activity of the game. If one player has a particularly long round, the resting player may become bored and lose interest in the game.

Another disadvantage to such competitive play is that it lacks the excitement and drama of games wherein players play simultaneously. Missing is a constant comparison of scores which occurs throughout the game; indeed, when competing by playing consecutive rounds, the winner is not known until after the final player completes his or her last round.

Moreover, competitive play through playing consecutive rounds does not allow the players to exercise any strategy against one another. The manner in which one player plays the game has no impact on how the other player plays the game. There is no opportunity to assume an offensive or defensive posture with respect to the other player. In fact, what results from such "competitive" play is that the first player actually competes with the machine and then the second player competes with the machine. The players then compare scores to ascertain who performed better against the machine. The players are not truly competing against each other.

Attempts have been made to overcome the problem of consecutive play. Games where two players play simultaneously are known, as indicated by Gottlieb et al., U.S. Pat. No. 3,675,927. However, in the pinball game disclosed in this patent, one player must assume a defensive role while the other maintains an offensive role. Presently no machine allows players to assume both offensive and defensive roles during the same play of the game. What is lacking is a truly competitive game where each player competes simultaneously against his or her opponent, as well as the machine.

SUMMARY OF THE INVENTION

In view of the above, it is an objective of this invention to provide a pinball game or machine where two or more players can play simultaneously and in competition with each other. In the invention, a multisurface pinball table is employed where each surface meets at the center of the pinball table. In this configuration, the ball is free to travel from one surface to another, and score points on any surface of the pinball table. A ball-sensing mechanism is included in order to keep track of which player contacted the ball last. A mechanism is also provided for changing the angle of at least one of the playing surfaces upon the occurrence of a predetermined event.

In a preferred embodiment, each player has control over the ball-engaging mechanism located on that player's side of the table. The player who last contacted the ball with a ball-engaging mechanism under that player's control is credited with any subsequently scored points. In this preferred embodiment, two playing surfaces are provided. Each surface meets in the middle of the table to form an apex over which the ball may roll. A scoring element is also provided that is capable of recording at least two scores. In this embodiment, each surface is originally oriented in an inclined position. An electromechanical mechanism is included that is capable of lowering the apex where the two surfaces meet to either a substantially horizontal position or an inverted position substantially below the horizontal.

Further embodiments include a mechanism for raising the outer ends of each paying surface in order to form a single, inclined playing surface similar to that commonly known in the art. A further embodiment includes use of more than two playing surfaces, all meeting together at the center of the pinball table.

The present invention has numerous advantages over pinball games or machines heretofore known in the art. With the present invention, players may compete simultaneously not only against a machine or computer, but against each other. The ability to temporarily suspend an opponent's play in order to score additional points also adds an element of strategy to the common pinball game. Further, the present invention is not limited to two players. In one embodiment of the present invention, more than two playing surfaces can be joined for an unlimited number of players.

The present invention will be further understood in view of the following detailed description of some presently preferred embodiments of the invention taken in conjunction with the accompanying drawings.

DETAILED DESCRIPTION OF PRESENTLY PREFERRED EMBODIMENTS OF THE INVENTION

Figure 1:
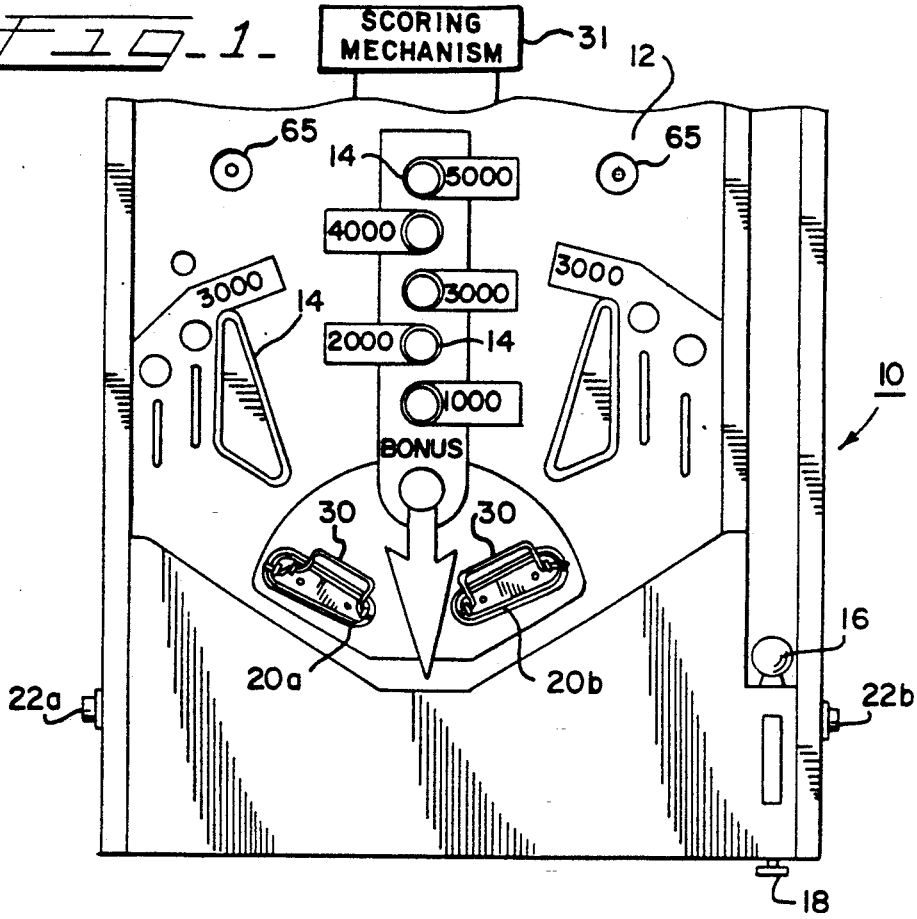
FIG. 1 is a top plan view of that part of a pinball table which employs a preferred embodiment of the sensor-equipped flippers made in accordance with the present invention.

Reference is now made to the figures wherein FIG. 1 shows a rolling ball game such as a pinball game or pinball machine. More particularly, in FIG. 1, a rolling ball game with a ball rolling surface or playing surface 12 is generally designated as 10. Although the following description of the invention is directed to a pinball machine, it will be recognized that the invention may be used on other games including games that do not use a "pinball", per se, but use any projectile object that moves across a playing surface under its own, or programmed, inertia, such as a puck, cylinder or other figure including a video game "cursor" or the like.

A plurality of ball-engaging mechanisms 14 are mounted on the playing surface 12 shown in FIG. 1. The ball-engaging mechanisms 14 may include a variety of elements such as post bumpers and slingshot bumpers, as well as other similar ball-engaging mechanisms that are well known in the art.

The ball-engaging mechanisms have a point value assigned to them such that when they are struck with a ball 16 during the play of the game, the player is credited with the assigned point value. Additionally, ball-engaging mechanisms for the game may include an element that propels the ball away from the ball-engaging mechanism when contacted by the ball, such as leaf or trigger switches (not shown). Such ball-engaging mechanisms are known in the art.

The pinball machine 10 further includes a plunger 18 which is biased with a spring (not shown), used to propel a ball 16 onto the playing surface 12 for play. The player stands at the end of the machine where the plunger 18 is located. In its elevated position, the playing surface 12 is sloped at a slight angle with respect to the horizontal so that the ball rolls toward the player. The ball contacts the ball-engaging mechanisms 14, and eventually works its way toward the player.

One or more ball-engaging mechanisms are operable by the player by means of a control element. As illustrated in FIG. 1, flippers 20*a* and 20*b* with their corresponding control buttons 22*a* and 22*b* are such moveable, player-controlled, ball-engaging mechanisms. Both flippers 20*a* and 20*b* can be actuated by pressing only one flipper button 22*a* or 22*b*, or alternatively, each flipper may be controlled by a separate, independent control mechanism. In a preferred embodiment, the left flipper button 22*a* corresponds to the left flipper 20*a* and the right flipper button 22*b* corresponds to the right flipper 22*b*, thereby allowing for independent actuation of the flippers 20*a* and 20*b*.

Means are provided for detecting contact of the moveable, ball-engaging mechanisms 20—the flippers—with the ball 16. As seen in FIG. 1, a U-shaped wire gate 30 is attached to each flipper 20*a* and 20*b*. When the ball 16 contacts either flipper 20*a* or 20*b*, the wire gate 30 pivots and is raised. The wire gate 30, in turn, actuates a scoring mechanism 31 that detects and records the contact of the ball 16 with the flipper. Such scoring and engaging mechanisms are not limited to use in pinball games alone, but may be configured with means for detecting contact of video game elements, such as a cursor, puck or any other moving, scoring elements known in the art. A more detailed description and some preferred embodiments of the means for detecting contact with the ball are disclosed in co-pending application Ser. No. 07/392,050, the contents of which are hereby incorporated by reference.

Besides scoring points from engaging the flipper itself, the scoring mechanism 31 preferably also thereafter credits points scored as the ball 16 hits various other scoring elements 14 to the player that last contacted the ball 16. In one of the embodiments of the invention illustrated in FIG. 1, a first player can maintain control over the left flipper while a second player maintains control over the right flipper. When the first player's flipper comes into contact with the ball 16, the wire gate 30 is raised, thereby triggering the scoring mechanism 31. However, in a more preferred embodiment of the present invention one player maintains control over both flippers (20*a* and 20*b*) on his or her side of the playing table, while the opposing player maintains control of both flippers (20*a* and 20*b*) on the other side of the playing table.

With the scoring mechanism 31 triggered in favor of the first player, all subsequent points scored as the ball strikes various scoring elements 14 on either playing surface are credited to the first player. The first player will continue to score points until the second player makes contact with the ball 16 through his flipper gate 20*a* or 20*b*, thereby triggering the scoring mechanism 31 in favor of the second player.

Figure 2:
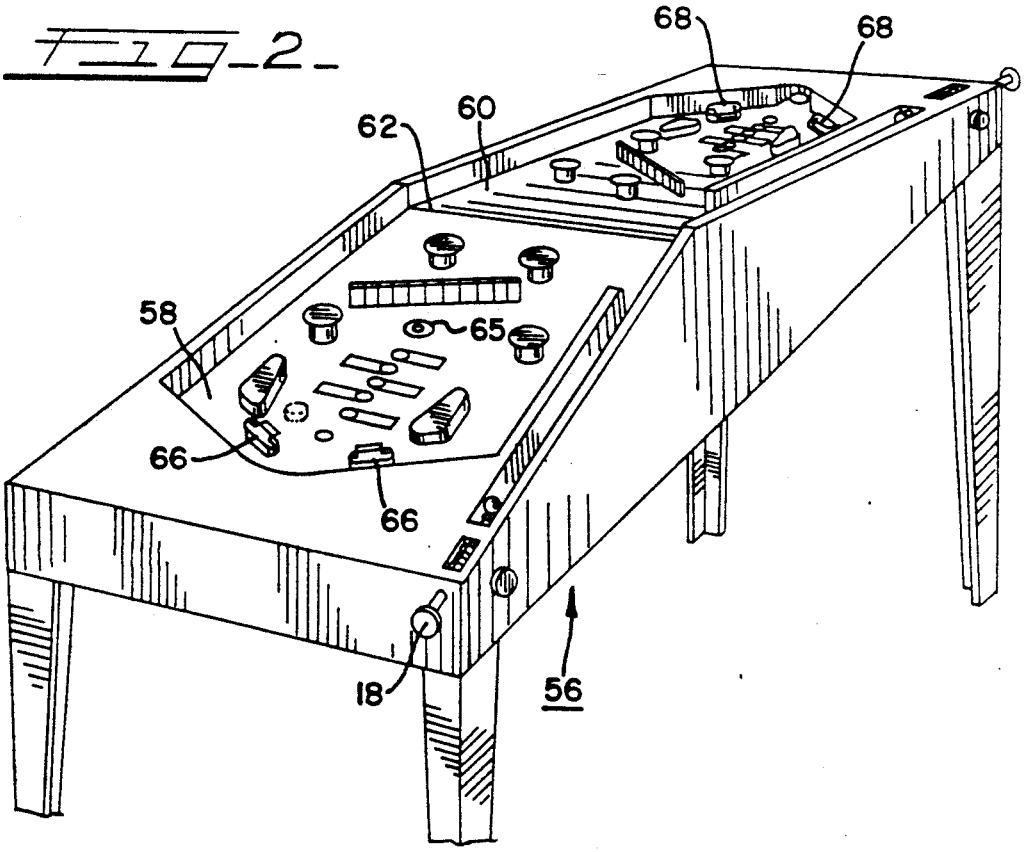
FIG. 2 is a perspective view of a dual-surface pinball table made in accordance with the present invention.

FIG. 2 illustrates a preferred embodiment of the multi-surface table of the present invention having two surfaces. In FIG. 2, a dual-surface pinball table is generally designated as 56. The dual-surface pinball table 56 includes a first playing surface 58 and a second playing surface 60. When playing competitive pinball with a dual-surface pinball table, a first player stands at the outer end of the first playing surface 58, with a second player standing at the outer end of the second playing surface 60.

Both playing surfaces 58 and 60 are originally inclined at opposing angles with respect to the horizontal. Thus, both surfaces 58, 60 meet to form a ridge or apex 62. The ball 16 can roll over the apex 62 onto either playing surface 58, 60. Each playing surface 58, 60 also has a variety of scoring elements 64 attached thereto.

Additionally, at least a pair of flippers 66 and 68 is provided for each playing surface 58, 60. In a preferred embodiment, these flippers are configured so that they operate independently. Thus, in one embodiment, two players can operate each flipper simultaneously and in competition with each other. However, when utilizing a dual-surface pinball table 56, it is preferable that the flippers 66, 68 be configured such that both flippers in a pair correspond to the player standing at that end of the respective playing surface 58, 60.

Figure 3:
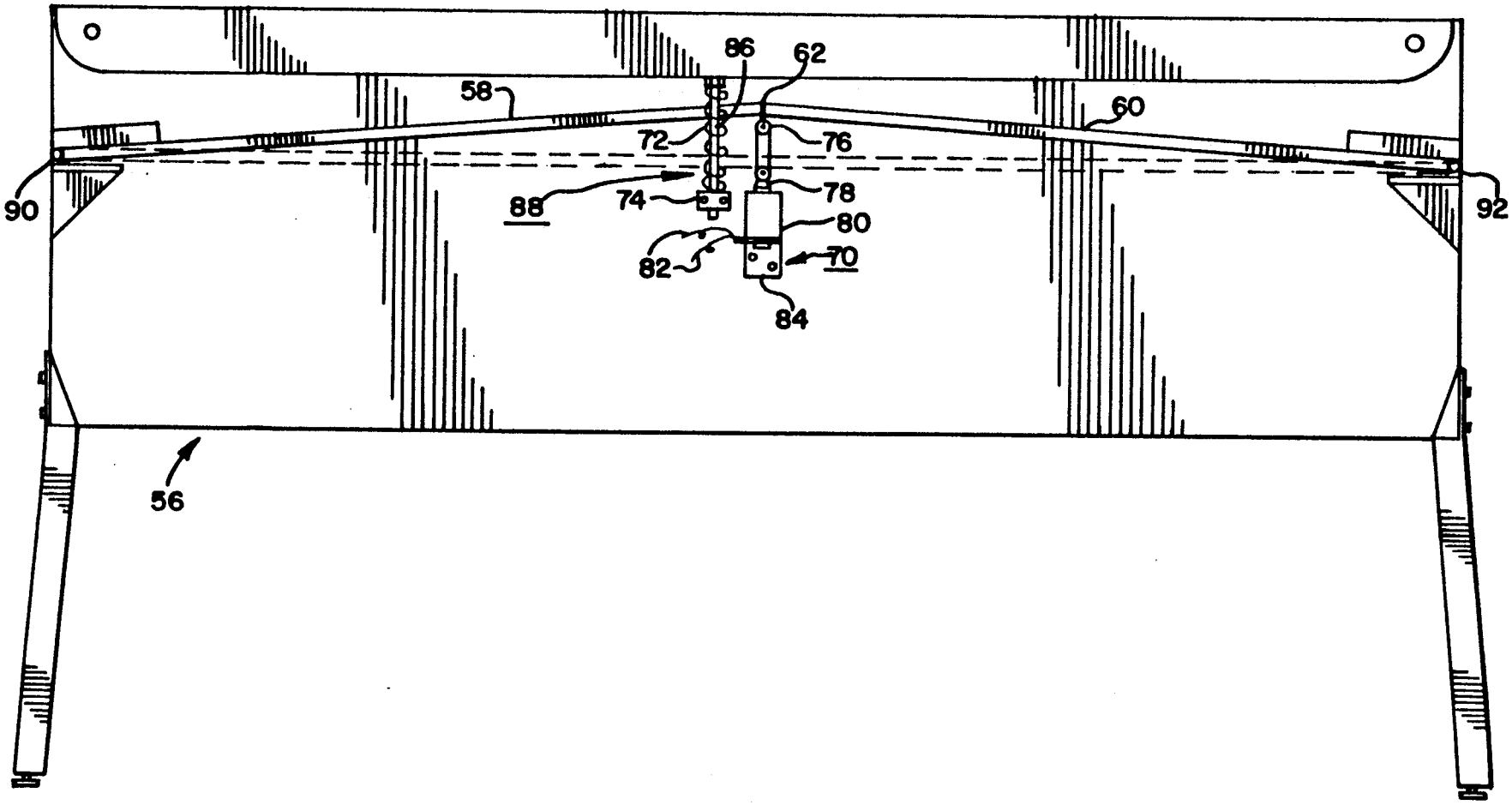
FIG. 3 is a sectional view of a lowering and elevating mechanism used on a multi-surface pinball table made in accordance with the present invention.

One preferred embodiment of the invention is shown in FIG. 3. In FIG. 3, the ridge 62 where the playing surfaces 58, 60 meet can be lowered to a substantially flat position (as indicated by the phantom lines of FIG. 3), and again elevated to its original inclined position. The raising and lowering of the playing surfaces 58, 60 can occur many times over the period of a single game.

At the start of a game the playing surfaces 58, 60 are in their oppositely inclined positions. When the ball 16 engages a specific target 65 (shown in FIG. 2), situated in one or more locations on each playing surface 58, 60, the surfaces 58, 60 are lowered to their horizontal configuration. In one preferred embodiment, this specific target 65 then ejects the ball 16 in front of that player's flipper 66 or 68 who caused the ball 16 to engage the target 65. That player then has the opportunity to shoot the ball 16 through his or her opponent's flippers 66 or 68, scoring a "goal" and additional points. If the player misses, or a period of time elapses before he or she shoots, the surfaces 58, 60 are raised to their original inclined positions.

In this embodiment, both playing surfaces 58, 60 are hingedly connected to the pinball table 56 by hinges 90, 92. Connected to a position below the ridge 62 is a drive mechanism 70 for lowering and elevating the playing surfaces 58, 60. This drive mechanism may include a hinge 76 attached to the underside of the ridge 62. The hinge 76 is further connected to a plunger 78, which is operated by an electrically controlled solenoid 80. A pair of lead wires 82 connect the solenoid to one or more of the scoring elements 64. The solenoid 80 is affixed to the pinball table 56 via a mounting bracket 84.

A spring mechanism 88 is also connected to the pinball table 56 via a mounting bracket 74. Seated on this mounting bracket 74 is a vertically positioned metal rod 84, which serves to align a spring 72. The spring 72 is used to counteract the force of the solenoid 80 in order to elevate the playing surfaces 58, 60 from their substantially flat position.

Figure 4:
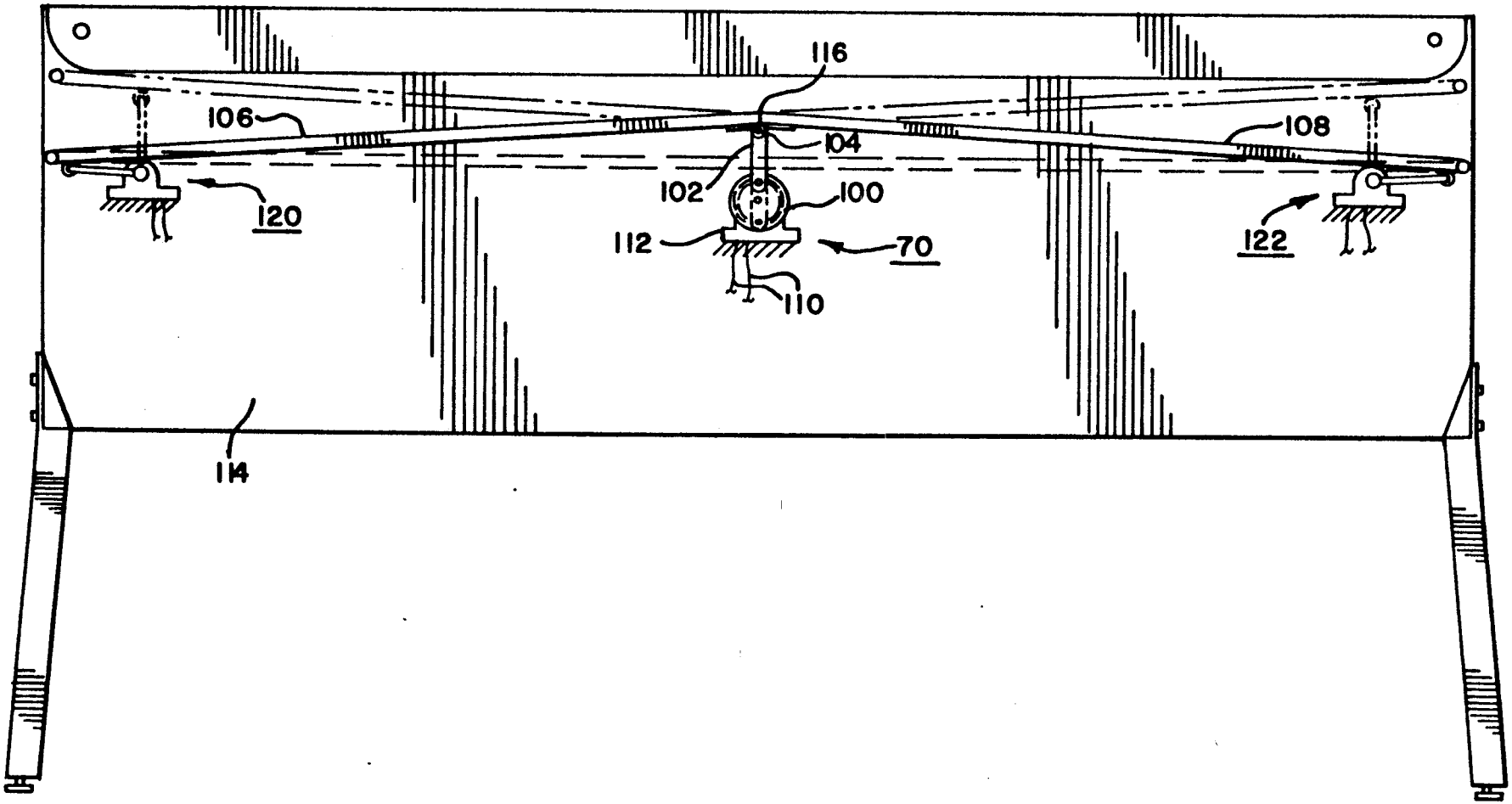
FIG. 4 is a sectional view of a preferred lowering and elevating mechanism, as well as an illustration of a multi-elevational embodiment of the present invention.

In another preferred embodiment shown in FIG. 4, the lowering and elevating drive mechanism 70 may include a motor 100, which drives a cam shaft 102. The cam shaft 102 is pivotally connected to a hinge 104 affixed to the undersides of the playing surfaces 106, 108 beneath the ridge 116. In this configuration, the motor 100 is attached to the pinball table 114 by a mounting bracket 112. A pair of lead wires 110 connect the motor 100 to one or more of the scoring elements 64.

During play of the game on such a dual-surface table, when one player's flipper 66, 68 comes into contact with the ball 16, the wire gate 30 on that flipper will rise, thereby triggering the scoring mechanism 31. All points thereafter scored are credited to that player, regardless of the playing surface 106, 108 on which the ball 16 is located when the points are scored, and until such time as another player's flipper 66, 68 comes into contact with the ball 16 thus triggering the scoring mechanism 31.

When one player causes the ball 16 to engage one of the specific target 65 described above, the playing surfaces 106, 108 are lowered to their flat positions. In a preferred embodiment, the specific target 65 may include kick-out holes or the like. However, other targets known generally in the art can also be used for this purpose. This kick-out hole will hold and trap the ball 16 until the surfaces 106, 108 are completely lowered, at which time the ball 16 is ejected as described above.

In an alternate embodiment, an elevating mechanism 120, 122 shown in FIG. 4, of a type similar to the lowering and elevating mechanism 70 described above, can be placed at the outer end of each playing surface 106, 108 in order to raise each surface to an oppositely inclined position forming a single, substantially flat playing surface with the other inclined surface. In this fashion, the pinball table 114 comprises one flat surface, inclined in favor of one player, that runs the length of the table 114 and resembles the more commonly seen pinball machine. Thus, by strategic play and scoring, one player can completely remove his or her opponent from play for a period of time.

A dual-surface table could also be adapted to provide a competitive pinball game in which four players can play simultaneously. By adjusting the scoring mechanism 31 to record four separate scores and assigning one player to each flipper, similar to the embodiment in FIG. 1, four players would be able to independently score points and thereby compete with each other. Alternatively, other embodiments may include additional playing surfaces so that more players can be added and each maintain control over both flippers positioned on their playing surface.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

I claim:

1. A pinball game, comprising:

a projectile;

at least two surfaces on which the projectile travels, the surfaces having a first position wherein each surface is disposed at a first angle with respect to the horizontal, and each surface having an upper edge and a lower edge, the upper edge meeting to form an apex that the projectile may travel over to move from one surface to another in the first position;

a drive mechanism to move the apex to and from a second position wherein each surface is disposed at a second angle with respect to the horizontal; and at least one projectile engaging mechanism operable by a player to project the projectile across the surfaces.

2. A pinball game as defined in claim 1, wherein the projectile comprises a ball.

3. A pinball game as defined in claim 1, wherein the projectile comprises a puck.

4. A pinball game as defined in claim 1, wherein the drive mechanism comprises a cam operatively connected to lower and raise the apex and a drive to move the cam.

5. A pinball game as defined in claim 1, wherein the drive mechanism comprises a solenoid operatively connected to move the apex in one of the raising and lowering directions and a spring biased in the other of the raising and lowering directions.

6. A pinball game as defined in claim 1, wherein the second position comprises a substantially horizontal position for each surface.

7. A pinball game as defined in claim 1, wherein the second position comprises a plurality of positions between the first position and a position substantially lower than the horizontal for each surface.

8. A pinball game as defined in claim 1, wherein the second position comprises a position substantially lower than the horizontal for each surface.

9. A pinball game as defined in claim 1, further comprising an actuator generating a trigger signal, the actuator operatively connected to the drive mechanism to engage the drive mechanism upon the occurrence of a predetermined event.

10. A pinball game as defined in claim 9, wherein the actuator comprises a clock and the predetermined event comprises an elapsed amount of time.

11. A pinball game as defined in claim 9, wherein the actuator comprises a target element disposed on at least one of the surfaces and the predetermined event comprises the projectile engaging the target element.

12. A pinball game as defined in claim 11, wherein the target element comprises an aperture, a sensing element disposed in the aperture to detect engagement of the projectile with the aperture and an ejector for ejecting the projectile from the aperture.

13. A pinball game as defined in claim 1, further comprising a scoring element configured to keep score for at least two players.

14. A pinball game as defined in claim 13, further comprising a projectile sensing mechanism operatively connected to a projectile engaging mechanism.

15. A pinball game as defined in claim 14, wherein the projectile engaging mechanism comprises a flipper element.

16. A pinball game as defined in claim 14, wherein the projectile sensing mechanism generates a contact signal to the scoring element so that all subsequently scored points are credited to a first player associated with that projectile sensing mechanism, until a second projectile sensing mechanism associated with a second player makes contact with the projectile.

17. A pinball game as defined in claim 1, further comprising a second drive mechanism connected to raise and lower the lower edges of the first and second surfaces to and from a third position substantially above the horizontal.

18. A pinball game, comprising:

a projectile;

at least two surfaces on which the projectile travels, the surfaces having a first position wherein each surface is disposed at a first angle with respect to the horizontal, and each surface having an upper edge and a lower edge, the upper edges meeting to form an apex that the projectile may travel over to move from one surface to another in the first position;

means for moving the apex to and from a second position wherein each surface is disposed at a second angle with respect to the horizontal; and at least one projectile engaging mechanism operable by a player to project the projectile across the surfaces.

19. A pinball game, comprising:

a projectile;

at least two surfaces on which the projectile travels, the surfaces having a first position wherein each surface is disposed at a first angle with respect to the horizontal, and each surface having an upper edge and a lower edge, the upper edges meeting to form an apex that the projectile may travel over to move from one surface to another in the first position;

a target element disposed on at least one of the surfaces; and an actuator, the actuator generating a trigger signal upon engagement of the projectile with the target element, the actuator operatively connected to a drive mechanism such that the drive mechanism receives the trigger signal to engage the drive mechanism to move the apex to and from a second position wherein each surface is disposed at a second angle with respect to the horizontal.

20. A pinball game, comprising:

a ball;

a first surface initially inclined with respect to the horizontal having an upper edge, and a second surface initially inclined with respect to the horizontal having an upper edge, the upper edge of the first surface meeting the upper edge of the second surface to form a ridge that the ball may roll over to get from one surface to the other;

a drive mechanism for lowering and raising the ridge to and from a substantially horizontal position;

a kick-out hole disposed on at least one of said first and second surfaces operatively connected to the drive mechanism to generate a trigger signal upon engagement of the ball;

a scoring mechanism configured to keep score for at least two players; and a first flipper element disposed on the first surface and a second flipper element disposed on the second surface, the first and second flipper elements configured to detect engagement of the ball and to communicate the engagement to the scoring mechanism.

* * * * *

UNITED STATES PATENT AND TRADEMARK OFFICE

CERTIFICATE OF CORRECTION

PATENT NO. : 5,064,196

DATED : November 12, 1991

INVENTOR(S) : Alvin J. Gottlieb

It is certified that error appears in the above-identified patent and that said Letters Patent is hereby corrected as shown below:

On the title page: under Other publications:

After "Attorney, Agent, or Firm" please delete "willian, Brinks, Olds, Hofer, Gilson & Lione" and substitute therefore --Willian Brinks Olds Hofer Gilson & Lione--.

Column 4, line 19, after "flipper" please delete 22b and substitute therefore --20b--.

Signed and Sealed this

Twenty-first Day of September, 1993

Bruce Lehman

*Attest:*

BRUCE LEHMAN

*Attesting Officer*

*Commissioner of Patents and Trademarks*